US008152157B2

(12) United States Patent
Horiuchi et al.

(10) Patent No.: US 8,152,157 B2
(45) Date of Patent: Apr. 10, 2012

(54) SHEET PROCESSING APPARATUS, SHEET TAKE-OUT APPARATUS, AND SHEET TAKE-OUT METHOD THEREOF

(75) Inventors: Haruhiko Horiuchi, Kanagawa-ken (JP); Atsushi Ina, Saitama-ken (JP); Mika Kimura, Kanagawa-ken (JP); Takao Mori, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/968,444

(22) Filed: Dec. 15, 2010

(65) Prior Publication Data

US 2011/0084440 A1 Apr. 14, 2011

Related U.S. Application Data

(60) Division of application No. 12/402,087, filed on Mar. 11, 2009, now Pat. No. 7,874,557, which is a continuation of application No. PCT/JP2007/000985, filed on Sep. 10, 2007.

(30) Foreign Application Priority Data

Sep. 13, 2006 (JP) ..... 2006-248597

(51) Int. Cl.
*B65H 3/14* (2006.01)

(52) U.S. Cl. ..... 271/98; 271/30.1

(58) Field of Classification Search ..... 271/97, 271/98, 30.1, 31, 152
See application file for complete search history.

(56) References Cited

U.S. PATENT DOCUMENTS

| | | | | |
|---|---|---|---|---|
| 5,027,293 | A * | 6/1991 | Pung et al. | 702/185 |
| 5,207,414 | A | 5/1993 | Schimanski et al. | |
| 5,460,360 | A * | 10/1995 | Kotani et al. | 271/3.13 |
| 5,478,066 | A | 12/1995 | Yoshida et al. | |
| 5,653,434 | A | 8/1997 | Petocchi et al. | |
| 6,892,872 | B2 | 5/2005 | Miyashita | |
| 6,918,581 | B2 * | 7/2005 | Horiuchi | 271/96 |
| 2003/0136630 | A1 | 7/2003 | Miyashita | |

FOREIGN PATENT DOCUMENTS

| | | |
|---|---|---|
| EP | 1331612 A2 | 7/2003 |
| JP | 63-175640 | 11/1988 |
| JP | 09-110207 | 4/1997 |
| JP | 2003-216999 | 7/2003 |

OTHER PUBLICATIONS

Japanese Office Action dated Dec. 27, 2010.

* cited by examiner

*Primary Examiner* — Michael McCullough
(74) *Attorney, Agent, or Firm* — Pillsbury Winthrop Shaw Pittman, LLP

(57) ABSTRACT

A sheet processing apparatus and a sheet take-out apparatus that prevents a sheet conveyed by a take-out portion from hanging-down and falling, when the take-out portion is stopped due to an emergency. If a take-out emergency process state occurs during the take-out of sheets, the sheet take-out apparatus stops upward movement of a backup plate, moves down feed stoppers, and presses a sheet bundle from above to prevent the sheet on the uppermost surface from being taken out. The sheet take-out apparatus also keeps a rotor air valve on and takes out the sheet caught in a sheet take-in port. When residual sheets on the backup plate are later detected, the sheet take-out apparatus moves down the position of the backup plate, turns off air valves for the rotor, fixed absorbing unit, and handling, and loads a hanging-down sheet on the backup plate, to prevent the sheet from scattering.

2 Claims, 11 Drawing Sheets

SHEET PROCESSING APPARATUS, SHEET TAKE-OUT APPARATUS, AND SHEET TAKE-OUT METHOD THEREOF

CROSS-REFERENCE TO RELATED APPLICATION

This application is a divisional of U.S. application Ser. No. 12/402,087, filed Mar. 11, 2009, now U.S. Pat. No. 7,874,557 which is a continuation of International Application No. PCT/JP2007/000985, filed on Sep. 10, 2007, and for which priority is claimed under 35 U.S.C. §121 and 120. This application is based upon and claims the benefit of priority under 35 U.S.C. §119 from the prior Japanese Patent Application No. 2006-248597, filed on Sep. 13, 2006. The entire contents of all of which are incorporated herein by references.

FIELD OF THE INVENTION

The present invention relates to a sheet processing apparatus for taking out, discriminating, and sorting sheets of marketable securities or others and more particularly to a sheet processing apparatus relating to the take-out process during operation stop thereof, a sheet take-out apparatus, and a sheet take-out method thereof.

DESCRIPTION OF THE BACKGROUND

A sheet processing apparatus for processing sheets of marketable securities or others has a sheet take-out apparatus and the sheet take-out apparatus takes out and conveys the sheets of a sheet bundle inserted in a batch according to the processing unit one by one. The sheets conveyed one by one are checked for the quality thereof (shape, damage, blurred print, soiled print) by a sheet check device and are sorted and stacked into normal bills (hereinafter, referred to as qualified bills), abnormal bills (hereinafter, referred to as disqualified bills), and rejection bills such as abnormal conveying bills and double feed bills or they are stacked and sealed. For example, qualified bills are bundled (hereinafter, referred to as sealed) by a paper belt as a binding belt every 100 sheets so as to form a bunch and as required, 10 bunches are stacked and sealed additionally by a paper belt to form a bundle.

The sheet take-out apparatus aforementioned, when a failure occurs in the sheet take-out portion or on the conveying path, stops the take-out operation. Further, even when an operator detecting an error stops the take-out, the apparatus stops the take-out operation.

If the take-out apparatus is stopped in this way, the conveyance of sheets is also stopped, so that so as to return sheets remaining on the conveying path to the backup plate, the backup plate moves down (for example, refer to Patent Document 1). Patent Document 1: Japanese Patent Application Publication No. 9-110207 (FIG. 1 shown on page 12)

However, in the sheet processing apparatus stated in the Patent Document 1, when the backup plate moves down, some sheets are adhered to the sheet guide plate (side wall) of the sheet feed portion and fall down on the lower part of the backup plate, so that a problem arises that they may not be processed. Hereinafter, it will be explained in detail by referring to FIGS. 9A to 9C.

FIG. 9A shows the status that when the backup plate moves down because the take-out apparatus is stopped for the reason aforementioned, a sheet Pa hangs down in a sheet take-in port 120*c* between a take-out rotor 210*b* and a fixed absorbing unit 120 which compose a take-out apparatus 1*b*.

FIG. 9B shows the status that the sheet Pa hanging down in FIG. 9A falls down by its own weight between a sheet bundle Pb and a sheet guide plate 130. Here, the case that the sheet Pa falls down so as to adhere to the side wall is shown.

FIG. 9C shows the case that the sheet remaining on the conveying path due to the obstacle aforementioned is returned onto the sheet bundle Pb loaded on the backup plate 110 and the take-out apparatus 1*b* is driven again without noticing the fallen sheet Pa. If the backup plate 110 moves up in correspondence to the driving of the take-out apparatus 1*b*, the sheet Pa stuck to the side wall may fall down on the lower part of the backup plate 110.

SUMMARY OF THE INVENTION

The present invention was developed to solve the aforementioned problems and is intended to provide a sheet processing apparatus, when the take-out portion is stopped, for preventing the sheet hanging down in the take-out portion from falling and conveying the sheet hanging down and stacking it on the rejection bill stacking device, thereby preventing the sheet from leaving behind in the take-out apparatus, a sheet take-out apparatus, and a take-out method thereof.

To accomplish the above object, the sheet processing apparatus of the present invention includes a supply table to which a sheet bundle is supplied, a take-out position detection means for detecting the sheet on the uppermost surface of the sheet bundle, a supply table drive means for moving up or down up to the take-out position of the sheet on the uppermost surface of the sheet bundle loaded on the supply table on the basis of the detection results by the take-out position detection means, a handling means for removing the adhesion of the sheet bundle loaded on the supply table by the supply table drive means, a take-out means for taking out the sheet on the uppermost surface of the sheet bundle, a plural sheets take-out prevention means of the sheets taken out by the take-out means, a rest means for resting the take-out of the sheets taken out by the take-out means, a conveying means for conveying the sheets taken out by the take-out means, a conveyance detection means for detecting the conveying status of the sheets, a sheet check means for checking for the quality of the sheets, a stack means for discriminating the sheets as a qualified bill, a disqualified bill, or a rejection bill on the basis of the detection results by the conveyance detection means and the check results by the sheet check means and sorting and stacking the concerned sheets on the basis of the discrimination results, a seal means for sealing the sheets stacked by the stack means, and a take-out control means, when an obstacle is detected in the sheet processing apparatus or when the sheet processing apparatus is stopped in an emergency by an operator, for stopping the supply table drive means and rest means by keeping the take-out means, handling means, and plural sheets take-out prevention means driven.

Further, the sheet tack-out apparatus of the present invention includes a supply table to which a sheet bundle is supplied, a take-out position detection means for detecting the sheet on the uppermost surface of the sheet bundle, a supply table drive means for moving up or down up to the take-out position for taking out the sheet on the uppermost surface of the sheet bundle loaded on the supply table on the basis of the detection results by the take-out position detection means, a handling means for removing the adhesion of the sheet bundle loaded on the supply table by the supply table drive means, a take-out means for taking out the sheet on the uppermost surface of the sheet bundle, a plural sheets take-out prevention means of the sheets taken out by the take-out means, a rest means for resting the take-out of the sheets taken out by the take-out means, and a take-out control means, when the take-out means is stopped or when the take-out means is stopped by an operator, for stopping the supply table drive means and rest means by keeping the take-out means, handling means, and plural sheets take-out prevention means driven.

Furthermore, the take-out method of the sheet take-out apparatus of the present invention is a take-out method of a sheet take-out apparatus including a supply table to which a sheet bundle is supplied, a take-out position detection means for detecting the sheet on the uppermost surface the sheet bundle, a supply table drive means for moving up or down up to the take-out position of the sheet on the uppermost surface of the sheet bundle loaded on the supply table on the basis of the detection results by the take-out position detection means, a handling means for removing the adhesion of the sheet bundle loaded on the supply table by the supply table drive means, a take-out means for taking out the sheet on the uppermost surface of the sheet bundle, a plural sheets take-out prevention means of the sheets taken out by the take-out means, and a rest means for resting the take-out of the sheets taken out by the take-out means, further comprising a first step, when the take-out of the sheets is stopped, of detecting it, a second step, when the take-out emergency process is requested as a result of the first step, of stopping the supply table drive means and rest means by keeping the take-out means, handling means, and plural sheets take-out prevention means driven, a third step of detecting the take-out end unless the take-out emergency process is requested, a fourth step of stopping the take-out means, handling means, plural sheets take-out prevention means, and supply table drive means when the take-out end is detected at the third step, and a fifth step, when the take-out emergency process is not requested at the first step and the take-out end is not detected at the third step, of controlling upward movement or downward movement of the supply table drive means according to the position of the sheets by the take-out position detection means for detecting the sheet on the uppermost surface of the sheet bundle.

DETAILED DESCRIPTION OF THE INVENTION

Hereinafter, the embodiment of the present invention will be explained with reference to the accompanying drawings.

Figure 1:
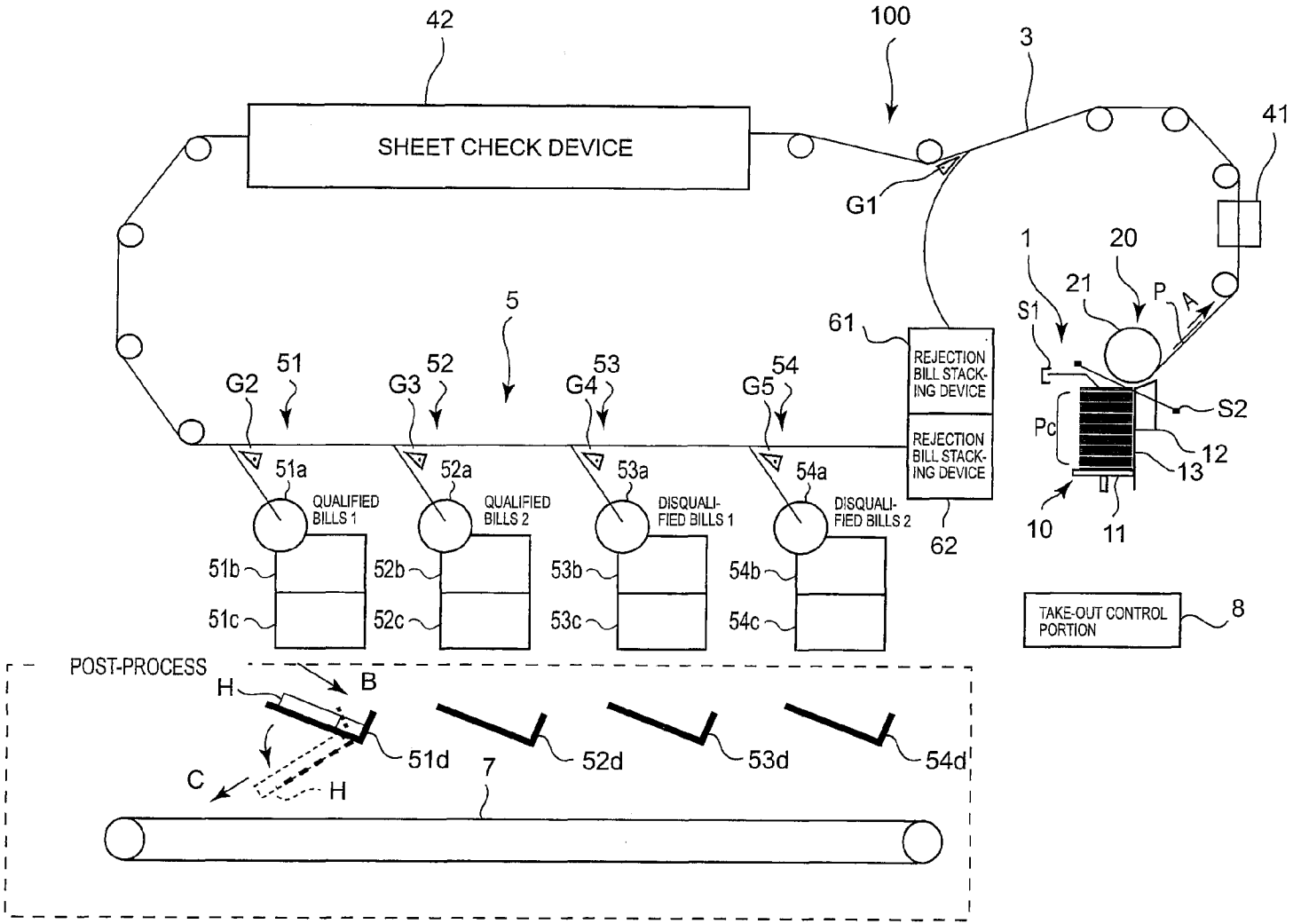
FIG. 1 is a schematic cross sectional view of the sheet processing apparatus equipped with the take-out apparatus according to the embodiment of the present invention.

FIG. 1 is a schematic block diagram of a sheet processing apparatus 100 equipped with a take-out apparatus (take-out means) 1 according to the embodiment of the present invention. The sheet processing apparatus 100 includes a take-out apparatus 1 for taking out supplied sheets P one by one in the direction of an arrow A drawn, a conveying path 3 for conveying the sheets P which are taken out one by one by the take-out apparatus 1 at a predetermined interval, a conveyance detection device (conveyance detection means) 41 for detecting the conveying status of the sheets P conveyed on the conveying path 3, a sheet check device (sheet check means) 42 for checking the print status of the sheets P, and a stack and seal apparatus 5 for stacking and sealing the sheets P on the basis of the check results by the sheet check device 42. Further, an abnormal conveying bill detected by the conveyance detection device 41 is stacked on a rejection bill stacking device 61 and a rejection bill based on the check results by the sheet check device 42 is stacked on a rejection bill stacking device 62.

Furthermore, a bunch H sealed and formed by the stack and seal apparatus 5 is conveyed to the post step by a carrying belt 7.

The post step includes a step of stacking 10 bunches H and furthermore forming a bundle and a step of sticking a label with a sheet attribute printed on the bundle formed in this way.

Figure 2:
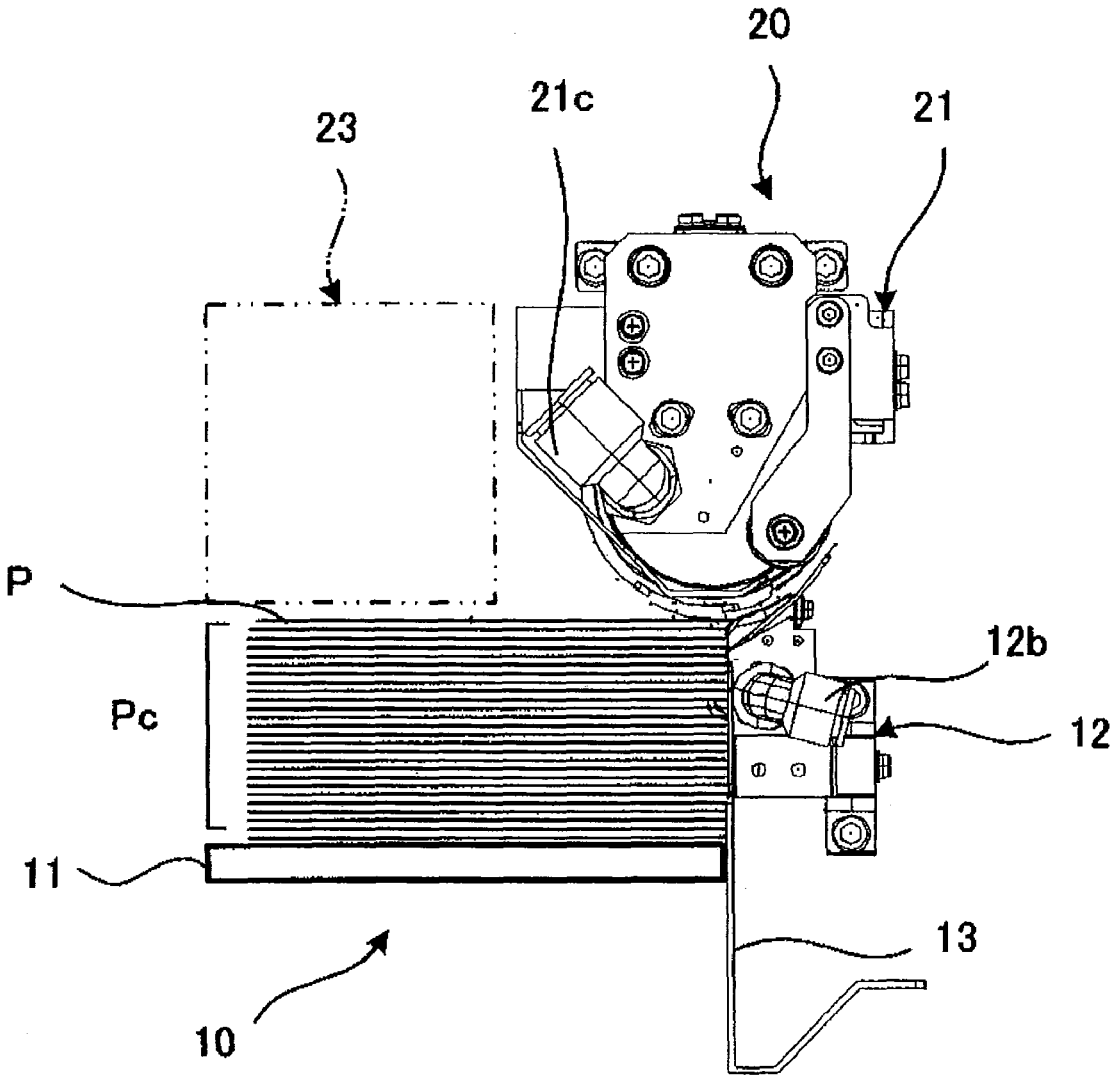
FIG. 2 is a front view of the take-out portion and supply portion of the take-out apparatus shown in FIG. 1.

As shown in FIG. 2, the take-out apparatus 1 further includes a supply portion 10 for supplying, for example, a 1000-sheet bundle Pc, which is one insertion unit, in a batch and a take-out portion 20 for taking out the sheet P on the uppermost surface of the sheet bundle Pc supplied to the supply portion 10 one by one at a predetermined interval.

The supply portion 10 includes a backup plate 11 as a supply table for loading the sheet bundle Pc and a take-out position detection device 23 as a take-out position detection means for detecting the take-out position of the sheet P on the uppermost surface of the sheet bundle Pc loaded on the backup plate 11.

The take-out position detection device, as shown in FIG. 1, is composed of a support (lever) rotatable around the supporting point. One end of the lever, to detect the sheet P on the uppermost surface of the sheet bundle Pc loaded on the backup plate 11, is composed of a contactor in contact with the top of the sheets P and the other end is a detection surface for detecting the movement distance of the contactor. Namely, if the position of the contactor varies with the take-out position of the sheet P, the changing amount is a variation of the detection surface aforementioned, so that if the changing amount is detected, the detection position of the sheets can be detected. As a take-out position sensor S1 for detecting the detection position, in this embodiment, a potentiometer is installed.

Further, the take-out position detection device has a supply table drive means (not drawn) for moving the position of the backup plate 11 up or down so as to permit the top of the sheets P to make contact with the take-out position sensor S1.

The take-out portion 20 is composed of a take-out rotor unit 21, a fixed absorbing unit 12, and a sheet guide plate 13.

The take-out rotor unit 21 has a take-out rotor as a take-out means, which can rotate forward and backward, for taking out the sheets P one by one from the uppermost surface of the sheet bundle Pc loaded on the backup plate 11. The take-out rotor takes out one sheet P every rotation by sucking in air due to negative pressure. The sheets P are taken out and conveyed continuously at a predetermined interval in the direction of the arrow A shown in the drawing. Further, the details will be described later.

The fixed absorbing unit 12 has an absorbing surface having an absorbing hole for sucking in air and is arranged at the position opposite to the take-out rotor unit 21. By use of such a constitution, when a plurality of sheets P are taken out by the take-out rotor unit 21, double conveyance of double feed can be prevented. Further, the details will be described later.

The sheet guide plate 13 guides the sheet bundle Pc loaded on the backup plate 11 up to the take-out position so as to prevent load shifting.

The sheet check device 42 checks for the print status of the sheets P conveyed. As a result of the check, the sheets P in the normal print status are discriminated as a qualified bill, and as a result of the check, the sheets P in the abnormal print status are discriminated as a disqualified bill, and uncheckable bills such as abnormal conveying bills and double feed bills are discriminated as a rejection bill.

The stack and seal apparatus 5 is composed of a stacking device as a stacking means and a sealing device as a sealing means. The stack and seal apparatus 5 includes a plurality of stack and seal apparatuses 51 and 52 for stacking and binding the qualified bills aforementioned and a plurality of stack and seal apparatuses 53 and 54 for stacking and binding disqualified bills.

Hereinafter, the stack and seal apparatus 51 will be explained as an example and the explanation of the stack and seal apparatuses 52 to 54 having the similar constitution will be omitted. The stack and seal apparatus 51 is composed of a stacking device and a sealing device for sealing sheets stacked on the stacking device.

As a stacking device, a paddle wheel stacking device is used as a means for taking out and separating sheets from the conveying path 3. The paddle wheel stacking device includes a paddle wheel 51*a* and a temporarily stacking storage 51*b*. The paddle wheel 51*a* is composed of a plurality of paddles incorporated around the rotary shaft and rotates in synchronization with the conveyance of the sheets P conveyed so as to receive them between the paddles. By use of the paddle wheel 51*a*, the kinetic energy of the sheets P conveyed at high speed can be absorbed, thus the sheets P can be stacked on the temporarily stacking storage 51*b* without causing damage to the sheets P.

A sealing device 51*c*, if the number of sheets P stacked on the temporarily stacking storage 51*b* reaches, for example, 100 which is set as a predetermined number, seals the 100 sheets with a paper belt to form a bunch H. The paper belt used in this case is printed with the attribute indicating the contents of the sealed sheets P and the device number, though it is not the object of the present invention, so that the details thereof will be omitted. The other stack and seal apparatuses 52 to 54 are structured similarly, so that the explanation thereof will be omitted.

Rejection bills discriminated by the sheet check device 42 are stacked on the rejection bill stacking device 62. In this embodiment, the paddle wheel stacking device is not used, though the case that it is used is also included in the object of the present invention.

The bunch H formed by the stack and seal apparatuses 51 to 54 is transferred to the post step. At the post step, shooting devices 51*d* to 54*d* as a temporarily holding means and a conveyer 7 as a conveying means of the bunch H are installed.

The shooting devices 51*d* to 54*d* respectively have a box having an opened take-in port and the bunch H can be taken in the box. Almost the center of the bottom of the box is born by a drive motor (not drawn). The drive motor is structured so as to rotate forward and backward and if the drive motor is driven, the link mechanism for transferring drive force is operated and the box is rotated. By this rotation, the conveying direction of the taken-in bunch H is reversed. As a result, the bunch H conveyed in the direction of the arrow B drawn is reversed in the direction of the arrow C drawn by the operation of the shooting portion and is discharged onto the conveyer 7.

The conveyer 7 takes in and conveys the bunch H discharged from the shooting devices 51*d* to 54*d*.

Figure 3:
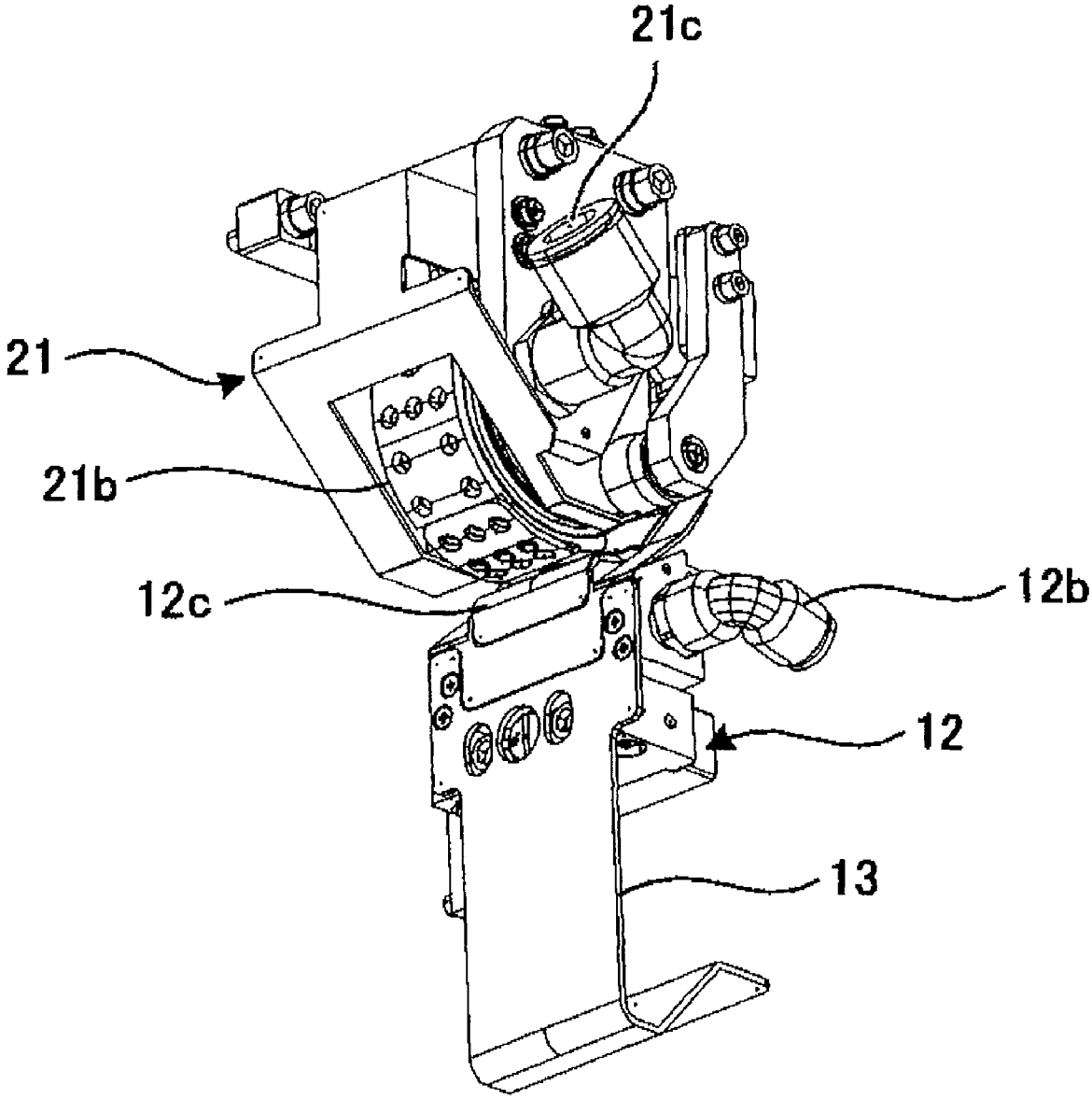
FIG. 3 is a perspective view of the take-out rotor unit and fixed absorbing unit of the take-out portion shown in FIG. 2.
Figure 4:
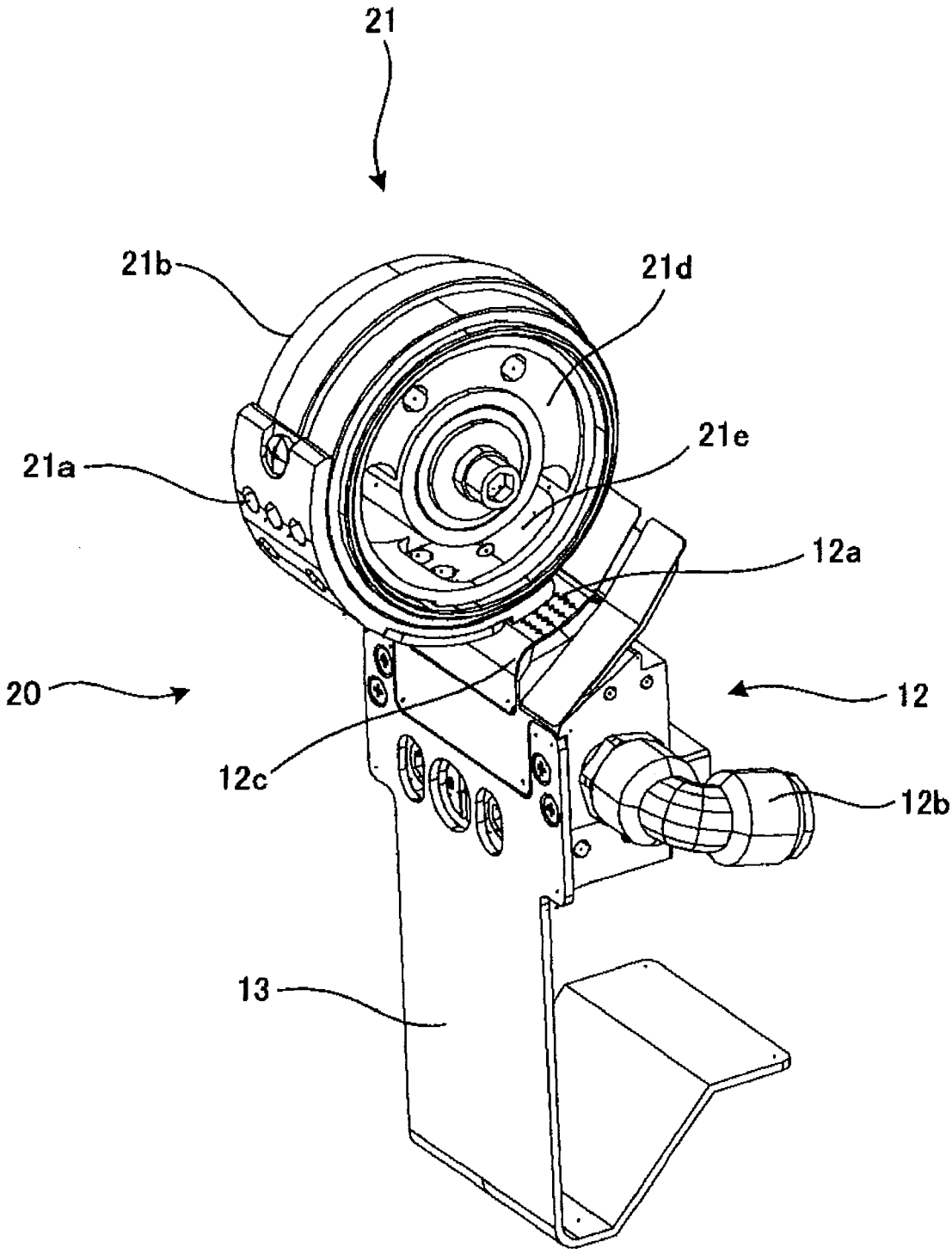
FIG. 4 is a perspective view of the take-out rotor and fixed absorbing unit composing the take-out rotor unit shown in FIG. 3.

FIG. 2 is a front view for explaining the take-out portion 20 and supply portion 10 of the take-out apparatus 1 of this embodiment. FIG. 3 is a perspective view of the take-out rotor unit 21 and fixed absorbing unit 12 of the take-out portion 20. FIG. 4 is a perspective view of the take-out rotor 21*b* and fixed absorbing unit 12 composing the take-out rotor unit 21. Hereinafter, by referring to FIGS. 2 to 4, the take-out apparatus 1 will be explained.

The take-out portion 20 is composed of the take-out rotor unit 21 for taking out the sheets P, the fixed absorbing unit 12 for preventing double conveyance of double feed, and the sheet guide plate 13, when moving the sheet bundle Pc loaded on the supply table 11 to the sheets take-out position, for guiding the sheet bundle Pc.

The take-out rotor unit 21 is composed of the take-out rotor 21*b* having an absorbing hole 21*a* and a rotation drive mechanism (not drawn) for driving the take-out rotor 21*b* to rotate. The take-out rotor 21*b* is internally equipped with an air suction port 21*c*, a fixed chamber 21*d*, and a notched hole 21*e* and is kept at a negative pressure so as to suck in air from the air suction port 21*c* by a vacuum pump (not drawn) and suck in sheets from the absorbing hole 21*a*. The air suction is controlled by on and off control of a rotor air valve (not drawn).

In the fixed absorbing unit 12, a plurality of absorbing holes 12*a* are formed on the opposite surface side of the take-out rotor 21*b*. Further, a sheet take-in port 12*c* is chamfered at a radius of 6 mm or more. Furthermore, the air suction port 12*b* connected to the absorbing hole 12*a* is connected to the vacuum pump (not drawn). When a plurality of sheets P are taken in between the take-out rotor 21*b* and the fixed absorbing surface 12*a*, air is sucked from the air suction port 12*b* by the vacuum pump, thus sheets P not absorbed by the take-out rotor 21*b* are absorbed and stopped. As a result, a plurality of sheets P can be prevented from being taken out simultaneously on the conveying path. The air suction control is executed by on and off control of the fixed absorbing air valve. Therefore, a plural sheets take-out prevention means is composed of on-off controllers (not drawn) for the air suction port 12*b* and fixed absorbing air valve.

Figure 5:
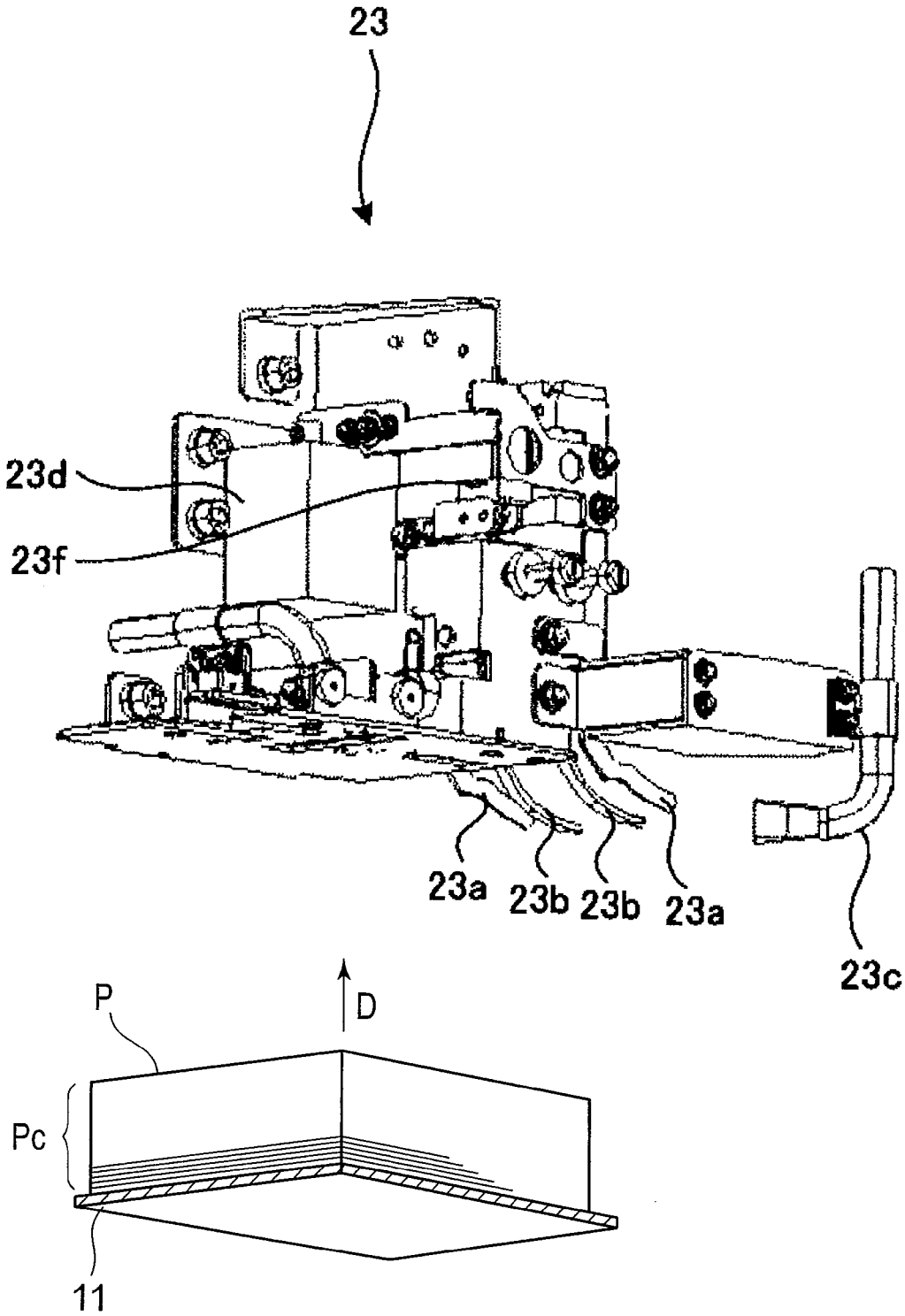
FIG. 5 is a perspective view of the take-out position detection device for detecting the take-out position of sheets which is viewed from the upstream side in the conveying direction.
Figure 6:
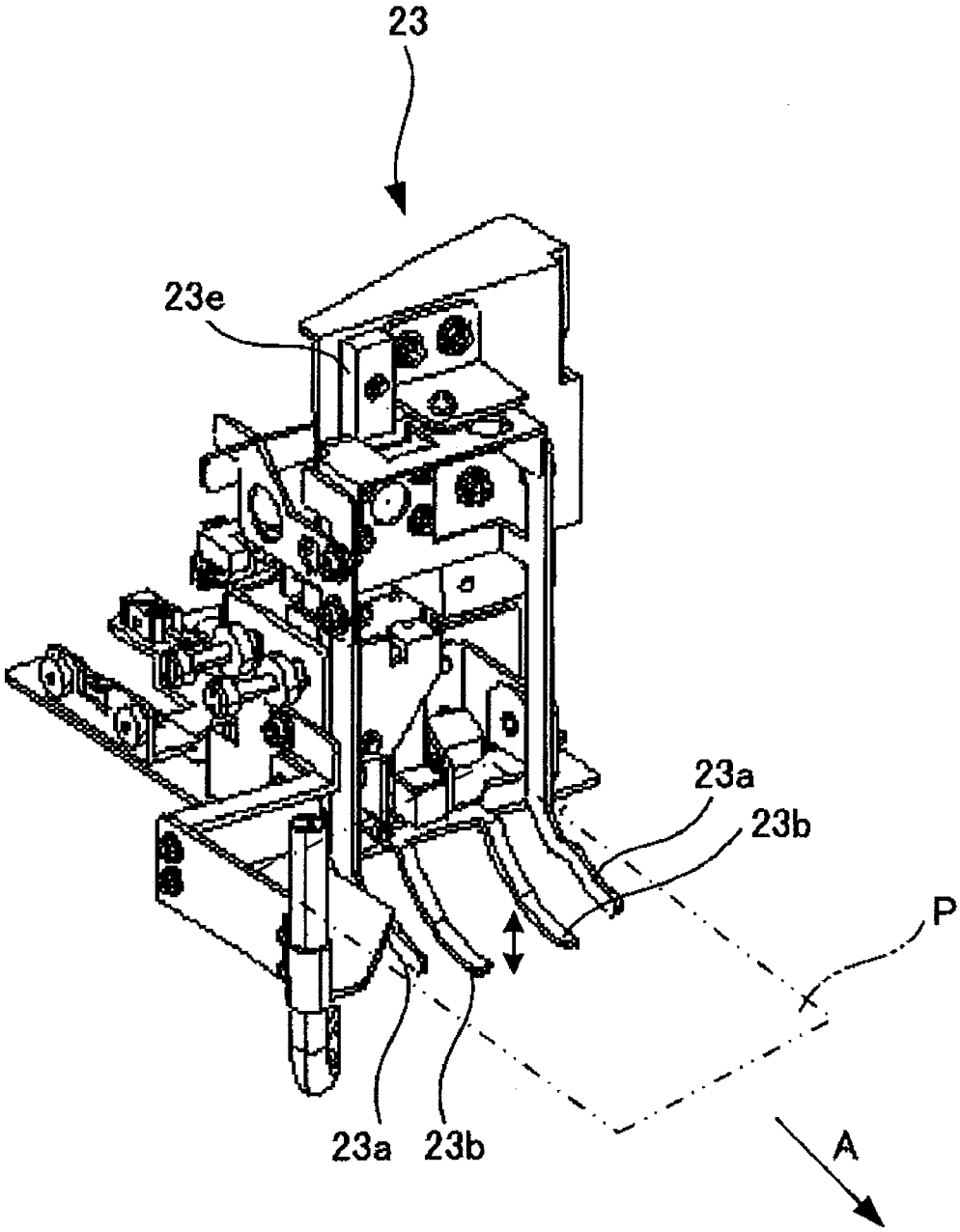
FIG. 6 is a perspective view of the take-out position detection device shown in FIG. 5 which is viewed from the downstream side in the conveying direction.

FIG. 5 is a perspective view of the take-out position detection device 23 for detecting the take-out position of the sheet P on the uppermost surface of the sheet bundle Pc which is viewed from the upstream side in the conveying direction. FIG. 6 is a perspective view of the take-out position detection device 23 shown in FIG. 5 which is viewed from the downstream side in the conveying direction. Hereinafter, the take-out position detection device 23 will be explained by referring to FIGS. 5 and 6.

The take-out position detection device 23 includes top position detection levers (supports) 23*b* for detecting the top position of the top sheet P of the sheet bundle Pc moving up, feed stoppers 23*a* as a resting means of the sheets P, and a handling air nozzle 23*c*.

Two top position detection levers 23*b* are arranged in the direction orthogonal to the conveying direction and detect that the top sheet P of the sheet bundle Pc loaded on the backup plate 11 reaches a predetermined position. The reason that two levers are arranged is that with respect to the thickness of the sheets P, even when the top is not uniform due to a print pattern and a partial loss, they are useful in detection of the top position.

The feed stoppers 23*a* are composed of a pressing lever for pressing the sheets P detected by the top position detection levers 23*b* from above and prevent the top sheets P from being taken out easily. The feed stoppers 23*a* are attached to a slide rail 23*e*. The slide rail 23*e*. If a solenoid 23*d* as an electromagnetic means is turned on, the feed stoppers 23*a* are pulled up by the slide rail 23*e* and if the solenoid 23*d* is turned off, the feed stoppers 23*a* move down by the own weight. The position of the slide rail moving up and down like this is detected by a sensor 23*f*.

The handling air nozzle 23*c* is connected to the exhaust pipe of the vacuum pump (not drawn) and the air blow-off control is executed by the on-off control of the handling air valve (not drawn) composed of an electromagnetic valve. Air is blown off (air exhaust) from the handling air nozzle 23*c*, thus the sheets P float from the sheet bundle Pc, thereby can be separated and taken out easily.

Figure 7:
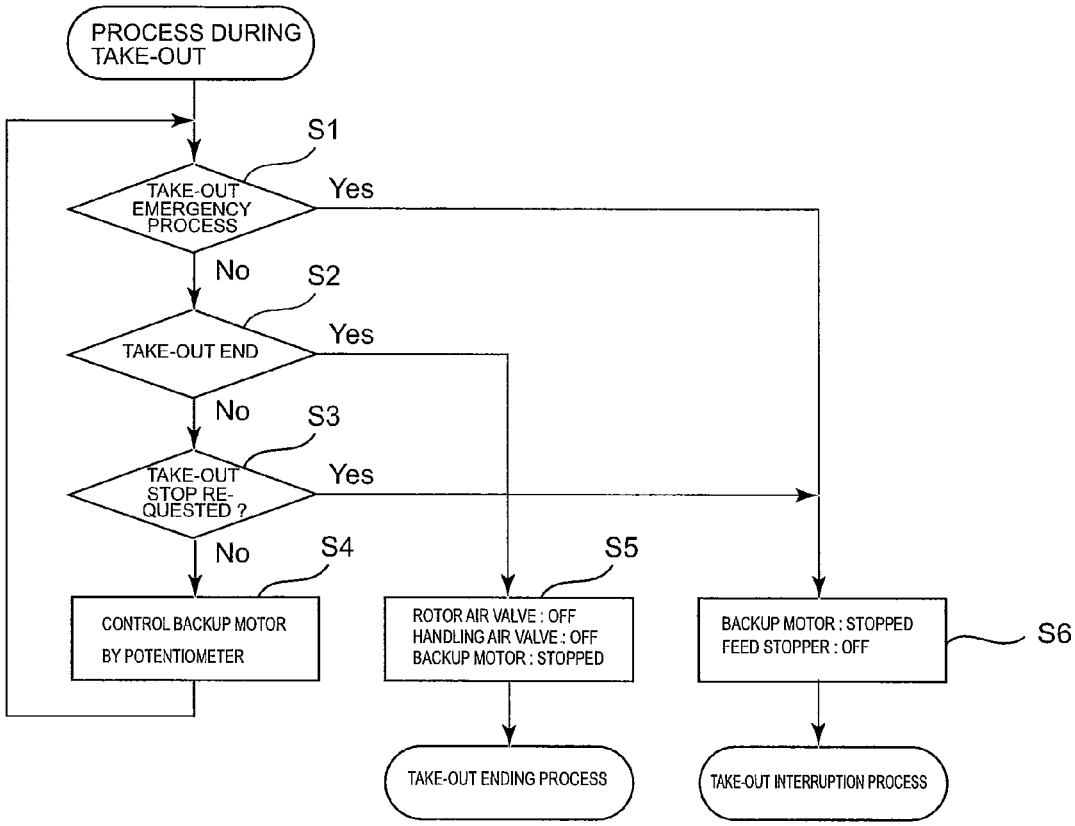
FIG. 7 is a flow chart for explaining the operation of the take-out apparatus of the present invention.

FIG. 7 is a flow chart for explaining the operation of the take-out apparatus of the present invention. If an obstacle is detected during take-out of the sheets P or the sheet processing apparatus 100 is stopped in an emergency by an operator and the apparatus enters a take-out emergency processing state (Yes at Step S1), a take-out control portion 8 stops the backup motor for moving up the backup plate 11 and turns off the feed stopper. If the feed stopper is turned off, the feed stoppers 23*a* move down and press the sheet bundle Pc stacked from above, thus the sheet P on the uppermost surface is prevented from additionally being taken out. In this case, in this embodiment, the rotor air valve is kept on and if there are sheets P caught in the sheet take-out port 12*c* of the take-out apparatus 1, the sheets P are taken out (Step S6).

Thereafter, the program goes to the take-out interruption process. The take-out interruption process varies with the use form of the apparatus. For example, if the sheets P are conveyed forcibly in correspondence to the take-out interruption, in this embodiment, the case of conveyance of double feed or continuous double conveyance of a plurality of sheets (feed of a plurality of sheets) may be considered. In this case, the sheets P conveyed are detected by the conveyance detection device 41 aforementioned and are stacked on the rejection bill stacking device 61. There are a case that the operator takes out and reprocesses the sheets P stacked on the rejection bill stacking device 61 or 62 and a case that the sheets stacked on the rejection bill stacking devices 61 and 62 are added to the sheets stacked on the temporarily stacking storages 51*b* and 52*b* and the operator forms manually a bunch H.

When the take-out emergency process at Step S1 is not performed, and the normal take-out is performed, and then the process ends (Yes at Step S2), the status is that there are no sheets P on the backup plate, so that the rotor air valve and handling air valve are turned off, and the backup motor is stopped, thus the take-out of the sheets P is stopped (Step S5).

Thereafter, the process goes to the take-out end process. The take-out end process performs continuously the post process of the bunch H formed as a result of the process, to process the sheet bundle in the next processing unit, moves down the backup plate to the lowest stage which is the home position, and sets up for reception of the next sheet bundle.

When a take-out stop request is issued during processing of the sheet bundle (Yes at Step S3), the take-out end process performs the process at Step S6 similarly to the take-out emergency process and the process goes to the take-out interruption process. Step S6 and the take-out interruption process are described above, thereby will be omitted.

When there is no take-out stop request at Step S3 (No at Step S3), the apparatus is under the normal processing and in this case, the backup motor is controlled by the potentiometer. The potentiometer is a device, according to the positions of the top detection levers 23*b* in the vertical direction, for converting the position data to an electric signal and by referring to the value indicated by the potentiometer, the position of the top sheet P indicated by the positions of the top detection levers 23*b* can be known. Namely, the control of the backup motor is control of moving the position of the top sheet to a fixed position in the neighborhood of the take-out rotor 21.

Figure 8:
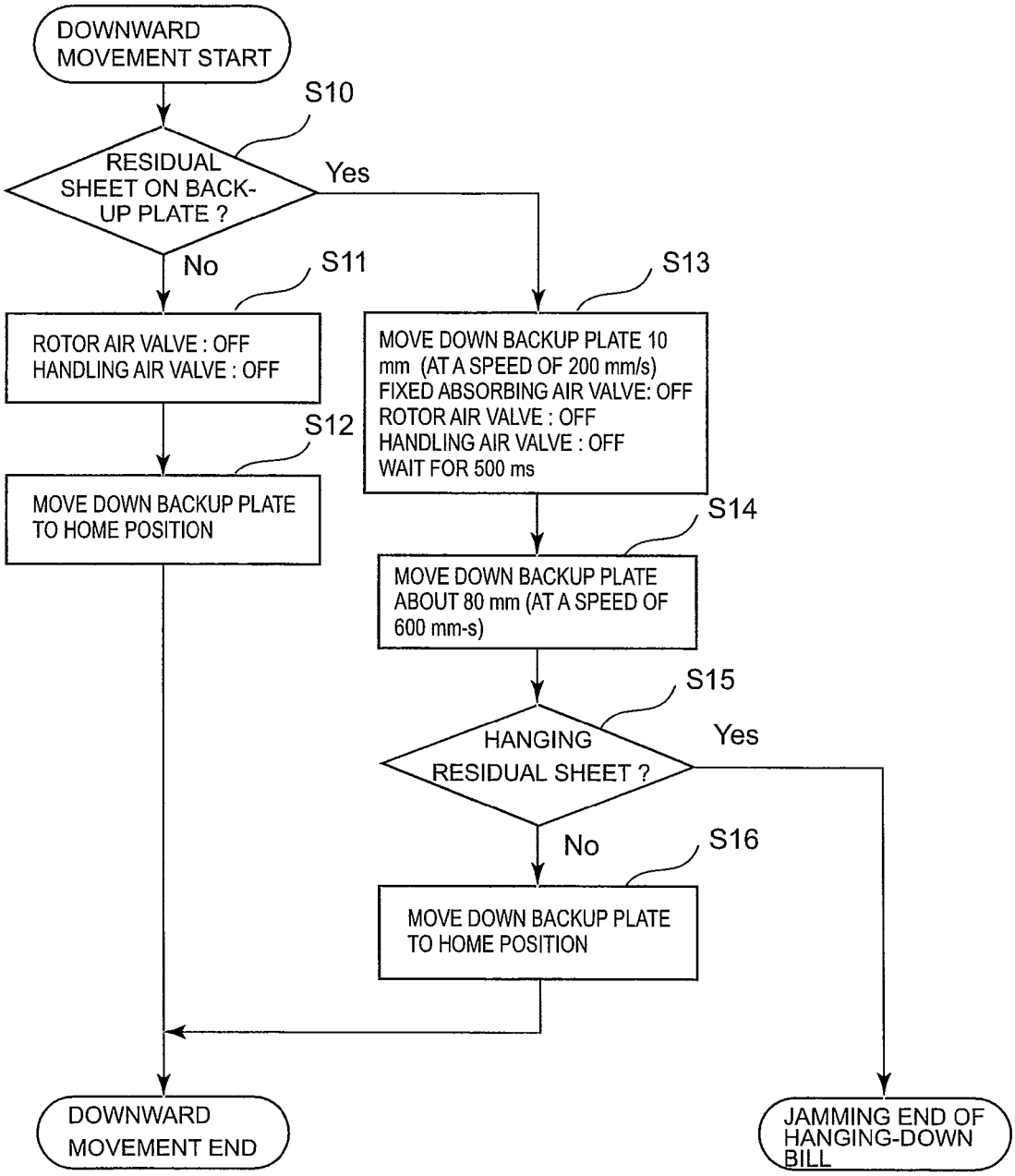
FIG. 8 is a flow chart for explaining the descending operation of the backup plate of the present invention in correspondence to the take-out interruption process and take-out end process shown in FIG. 7.

FIG. 8 is a flow chart for explaining the descending operation of the backup plate of the present invention in correspondence to the take-out interruption process and take-out end process shown in FIG. 7.

As a result of the take-out interruption process or take-out end process, the residual sheets P on the backup plate are detected by a sensor not drawn (Step S10).

Figure 9A:
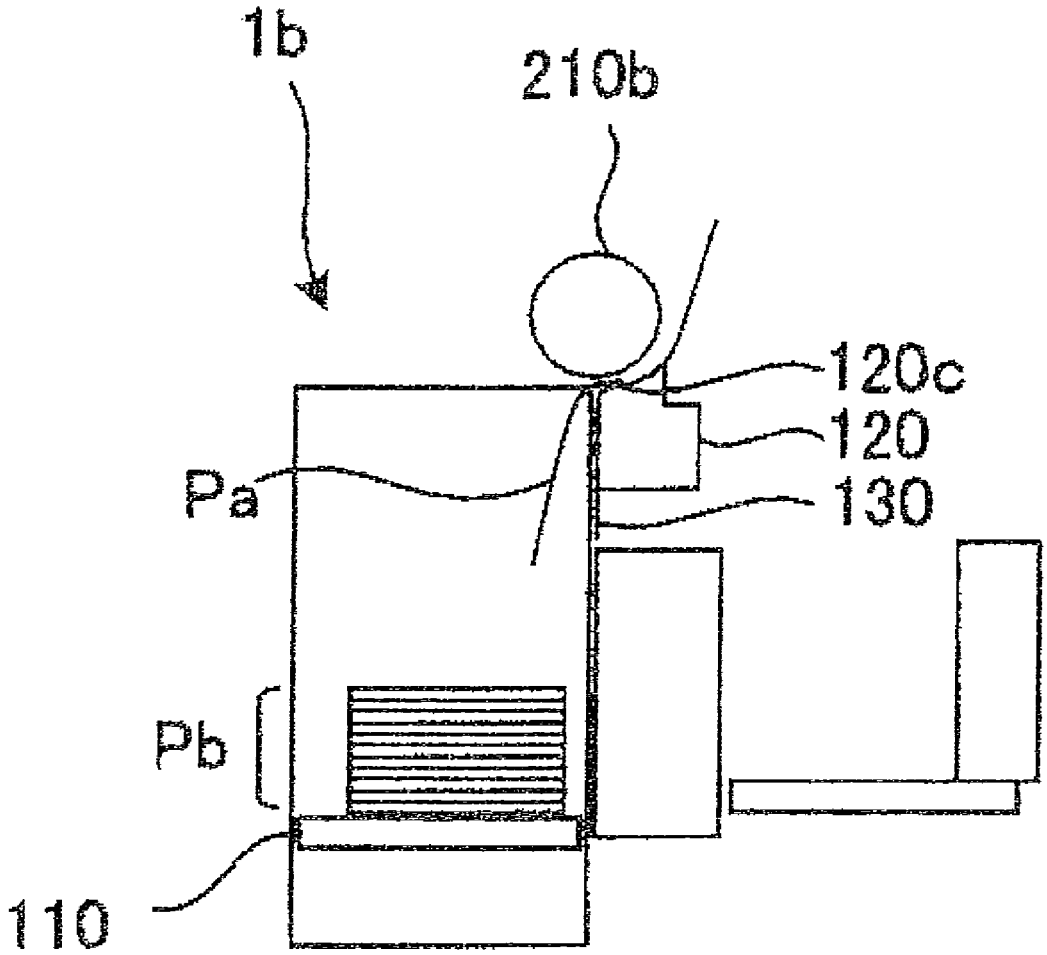
FIG. 9A PRIOR ART
FIG. 9A is a schematic view showing the conventional embodiment.
Figure 9B:
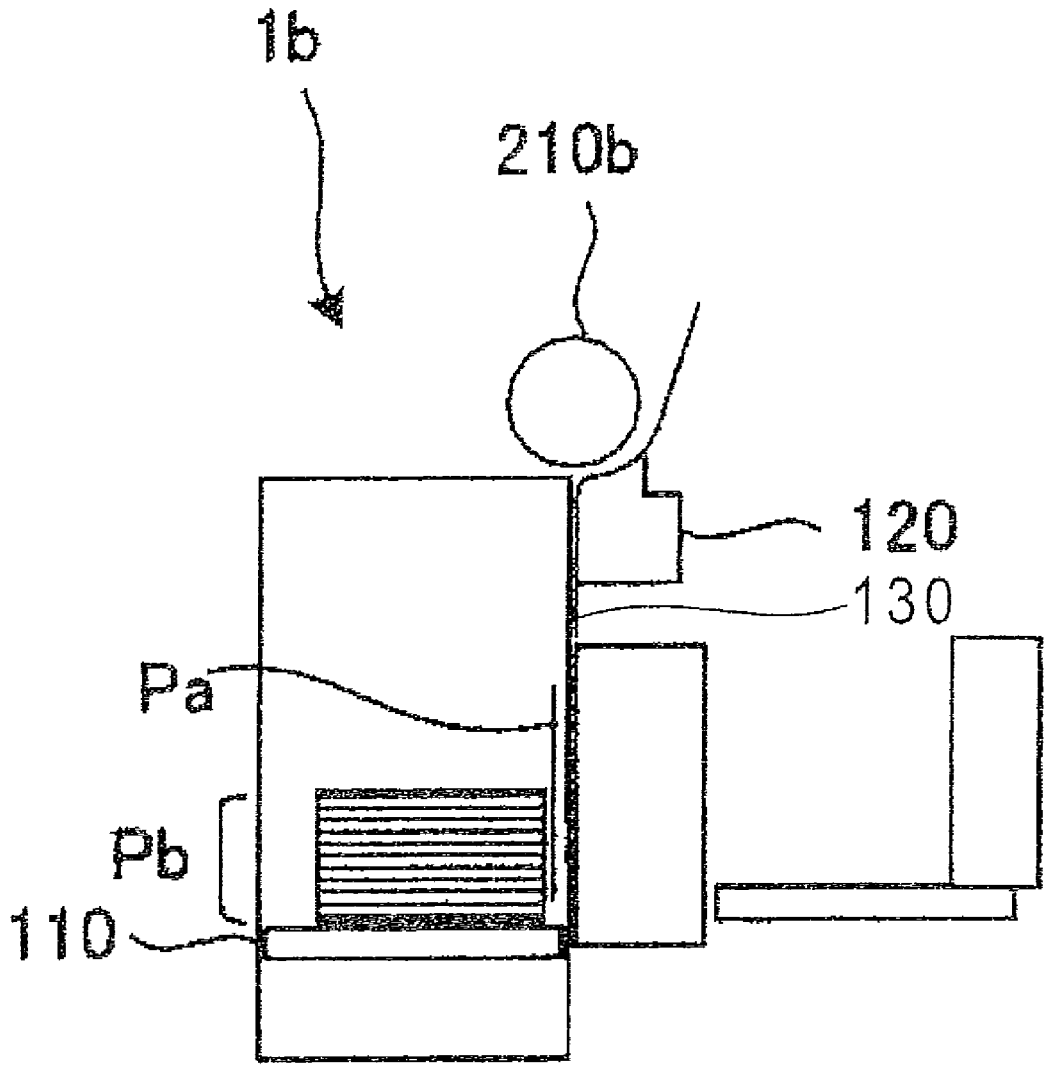
FIG. 9B PRIOR ART
FIG. 9B is a schematic view showing the conventional embodiment.
Figure 9C:
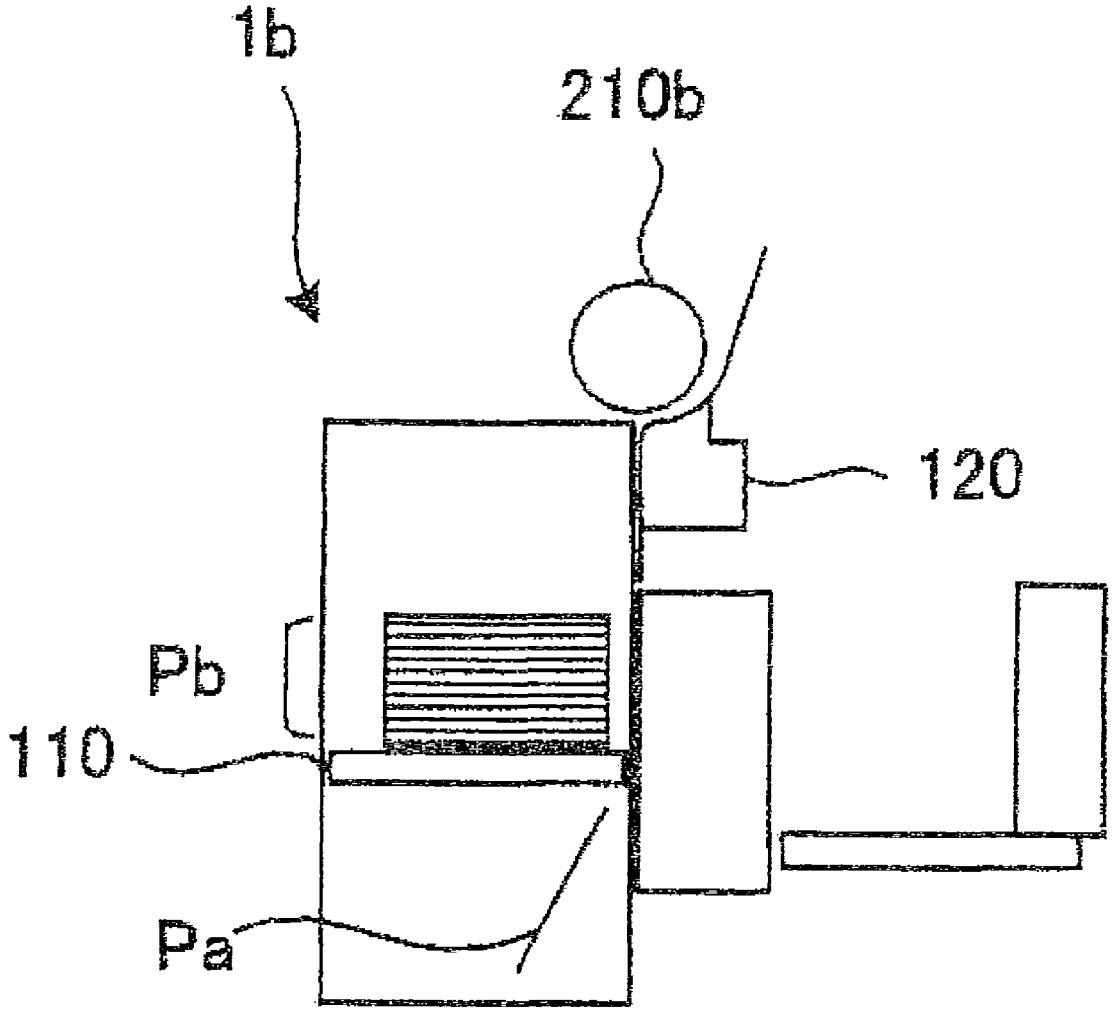
FIG. 9C PRIOR ART
FIG. 9C is a schematic view showing the conventional embodiment.

When the residual sheets P are detected as a result of the detection (Yes at Step S10), if the backup motor is driven, the backup plate 11 moves down at a first distance (for example, 10 mm) and at a first speed (for example, a speed of 200 mm/s). Simultaneously, the rotor air valve, fixed absorbing air valve, and handling air valve are turned off. Thereafter, the status is held for 500 ms. By doing this, the sheet hanging down shown in FIG. 9A is loaded on the backup plate.

Next, if the backup motor is driven further, the backup plate 11 moves down at a second distance (for example, 80 mm) and at a second speed (for example, 600 mm/s). If there is a sheet hanging down when this process is performed, the state of the sheet is stable and the hanging-down residual sheet is detected again (Step S15).

As a result of the detection of the hanging-down residual sheet, when the hanging-down residual bill is detected (Yes at Step S15), it is assumed that the state of the take-out apparatus 1 is kept held and the hanging-down sheet causes jamming.

As a result of the detection of the hanging-down residual sheet, when there is no hanging-down residual bill (No at Step S15), the backup motor (BUMT) is driven and the backup plate 11 moves down more to the home position (Step S16).

When there is no residual bill on the backup plate 11 at Step S10 (No at Step S10), the rotor air valve and handling air valve are turned off (Step S11) and the backup plate 11 moves down to the home position (Step S12).

As explained above, according to the embodiment of the present invention, when the take-out portion is stopped by the take-out emergency process, the backup motor is stopped, and the feed stopper is turned off, thus the stacked sheets are prevented from being taken out furthermore, and the sheet hanging in the take-out portion is conveyed and can be stacked on the rejection bill stacking device, so that the hanging-down sheet can be prevented from falling. Further, when a hanging-down sheet is detected on the backup plate, the backup plate is moved down slightly and the concerned hanging-down sheet falls by its own weight and is loaded on the backup plate.

According to the present invention, when the take-out apparatus is stopped, the hanging-down sheet is conveyed and is stacked on the rejection bill stacking device, thus the hanging-down sheet can be prevented from being left in the take-out apparatus.

What is claimed is:

1. A take-out method of a sheet take-out apparatus that includes a supply table to which a sheet bundle is supplied, take-out position detection means for detecting a sheet on an uppermost surface the sheet bundle, supply table drive means for moving up or down to a take-out position of the sheet on the uppermost surface of the sheet bundle loaded on the supply table based on detection results by the take-out position detection means, handling means for removing adhesion of the sheet bundle loaded on the supply table by the supply table drive means, take-out means for taking out the sheet on the uppermost surface of the sheet bundle, plural sheets take-out prevention means of the sheets taken out by the take-out means, and rest means for resting the sheets taken out by the take-out means, the method comprising:

detecting a request to stop the taking out of the sheets by the take-out means;

detecting a take-out end process;

stopping the take-out means, handling means, plural sheets take-out prevention means, and supply table drive means when the take-out end process is detected; and controlling, when the take-out end process is not detected, upward movement or downward movement of the supply table drive means according to a position of the sheets to detect, by the take-out position detection means, the sheet on the uppermost surface of the sheet bundle.

2. The method according to claim 1, further comprising:

when the stop request is based on a take-out emergency process, stopping the supply table drive means and rest means while keeping the take-out means, handling means, and plural sheets take-out prevention means driven.

* * * * *